US005635975A

United States Patent [19]

Shirakawa et al.

[11] Patent Number: 5,635,975

[45] Date of Patent: Jun. 3, 1997

[54] THERMAL HEAD

[75] Inventors: Takashi Shirakawa, Takizawa-mura; Toshifumi Nakatani, Morioka; Shinichi Sagawai, Takizawa-mura; Hirotoshi Terao, Morioka, all of Japan

[73] Assignee: Alps Electric Co., Ltd., Tokyo, Japan

[21] Appl. No.: 713,976

[22] Filed: Sep. 13, 1996

Related U.S. Application Data

[63] Continuation of Ser. No. 502,798, Jul. 14, 1995, abandoned.

[30] Foreign Application Priority Data

Jul. 26, 1994 [JP] Japan ..... 6-174198

[51] Int. Cl.[6] ..... B41J 2/335

[52] U.S. Cl. ..... 347/208

[58] Field of Search ..... 347/200, 202, 347/205, 206, 208

[56] References Cited

U.S. PATENT DOCUMENTS 4,743,923 5/1988 Nishiguchi et al. ..... 347/202

FOREIGN PATENT DOCUMENTS 62-71664 2/1987 Japan ..... 347/208

5-309853 11/1993 Japan .

*Primary Examiner*—Benjamin R. Fuller

*Assistant Examiner*—L. Anderson

*Attorney, Agent, or Firm*—Guy W. Shoup; Patrick T. Bever

[57] ABSTRACT

A thermal head which can effectively use a thin film ribbon as an ink ribbon, and take a relatively long edge distance. The thermal head has its object to maintain transferring property of the ink to a recording medium and to maintain high printing quality for a long period of time. A heating portion is formed from the top of a heat insulating layer to a slope of the common electrode side of the heat insulating layer, and a gap is formed on the common electrode. The ink ribbon is pressed into contact with the recording medium at a portion of low-temperature of the top of portion of the heat insulating layer falling outside the center portion of the heating portion where a pressure of the printer to the platen is mainly applied.

8 Claims, 1 Drawing Sheet

THERMAL HEAD

This application is a continuation of application Ser. No. 07/502,798, filed Jul. 14, 1995 now abandoned.

BACKGROUND OF THE INVENTION

1. Field of the Invention

The present invention relates to a thermal head which is mounted on a thermal printer and is energized and heated in accordance with printing information to perform a desired printing.

2. Description of the Related Art

In general, a thermal head mounted on a thermal printer is used in contact with a recording medium such as an ink ribbon or a heat-sensitive paper. In such a thermal head, a plurality of heater elements are arranged linearly on a substrate, and some of the heater elements are selectively and sequentially energized and heated so that the thermal head performs printing by coloring a heat-sensitive recording paper in a thermal printer, and by partially fusing ink of an ink ribbon to transfer a plain paper in a thermal transfer printer.

FIG. 3 illustrates one example of the conventional thermal head of this type. Referring to FIG. 3, a plane glaze layer 2 composed of a heat-resistant glass having low thermal conductivity and functioning as a heat insulating layer is formed on the upper surface of an insulating substrate 1 composed of alumina and the like. A protruding portion 2*a* of the glaze layer 2 having a height of about 5–10 μm and an approximately trapezoidal sectional configuration is formed integrally on the top surface within an area that will form heating portion 3A of the heater elements 3. On the top surface of the glaze layer 2, a plurality of heater elements 3 composed of heat resistant materials such as $Ta_2N$, Ta—$SiO_2$ or the like are formed in line by being totally laminated with vapor deposition or sputtering and then by being subjected to etching of a photolithographic technique. On the top surfaces of both ends of the heater elements 3, a common electrode 4*a* and an individual electrode 4*b* are formed, respectively, for energizing each of the heater elements 3. Each of the electrodes 4*a* and 4*b* are composed of soft metal having good conductivity such as Al, Cu and A, and formed into desired shapes by being totally laminated with vapor deposition or sputtering and then by being subjected to etching of a photolithographic technique.

Each of the heater elements 3 are formed individually between the common electrode 4*a* and the individual electrode 4*b* so that they expose heating portions 3A thereof each corresponding to one dot which is a minimum printing unit. The heating portion 3A of the heater elements 3 is heated through the application of a voltage between the electrodes 4*a* and 4*b*.

A protective layer 5 having a thickness of about 7–10 μm is laminated on the upper surfaces of the insulating substrate 1, the glaze layer 2, the heater elements 3 and each of the electrodes 4*a* and 4*b* so as to cover the entire surfaces except terminals of each of the electrodes 4*a* and 4*b*.

In a thermal transfer printer (not shown) using the conventional thermal head as described above, the individual electrode 4*b* which is connected to the heater elements 3 selected on the basis of desired printing signals is energized under a condition that the thermal head is pressed into contact with a desired recording medium (not shown) such as a paper carried to the front of a platen through an ink ribbon so as to heat up the selected heater elements 3. By this, the ink of the ink ribbon (not shown) which abuts against the heated heater elements 3 is fused to be transferred to the recording medium so as to perform desired printing of characters and figures thereon.

In the conventional thermal head as described above, desired heater elements 3 are arranged on the protruding portion 2*a* of the glaze layer 2 to form the heating portion 3A so that abutting property of the thermal transfer printer (not shown) against the platen is enhanced and printing quality is improved.

In recent years, in a thermal transfer printer, efforts have been made to obtain faster printing speed and higher definition by the thermal head and to improve printing quality, and various measures have been taken against the thermal head and the ink ribbon.

As a specific example of obtaining faster printing speed, higher definition and improved printing quality by the thermal head, a thermal transfer printer converting materials of the conventional ink ribbon from wax of a type stripped during low-temperature condition to resins of a type stripped during high-temperature condition has been proposed. With this proposal, the thermal head is, as shown in FIG. 4, made into a so-called real edge type in which a heating portion 3A is provided on the protruding portion 2*a* of the glaze layer 2 formed by offsetting on the insulating substrate 1 which is a rear end portion with respect to the travel direction of the thermal head, and a distance between the heating portion 3A and the edge portion which contributes stripping of the ink ribbon is short. The thermal head of this type is so constructed as to perform so-called stripping during high-temperature condition in which the ink ribbon is stripped from the recording medium before the ink heated and fused by the heating portion 3A is cooled to be solidified.

However, according to a thermal head of a real edge type in which the protruding portion 2*a* of the glaze layer 2 on which the heating portion 3A is formed, the space for the common electrode is very small. Thus, it has provided poor yield and led to an increase in cost.

In addition, for the thermal transfer printer in recent years, further speed-up of the printing speed, higher definition and higher printing quality by the thermal head have been required. For example, the printing speed of the thermal head required is 100–150 cps, and the resolution is 360–400 dpi and further moving to 600 dpi. The printing speed is becoming faster, and a smaller size of a dot which is a heat unit approximately equivalent to an area of one heating portion 3A is required. To satisfy this requirement, a resin ink ribbon having higher thermal transfer sensitivity has been proposed.

That is, a resin ink ribbon of a type striped during high-temperature condition, so-called thin film ribbon has been proposed in which the thickness of an ink layer and a base film layer of the ink ribbon are reduced so as to substantially reduce the thickness of the entire ink ribbon from 10 μm to 5 μm. In a thin film ribbon of this type, as the thickness of the ink ribbon is reduced, a thermal transmittal speed of the ink ribbon is increased, and thermal capacity is remarkably lowered. The thin film ribbon is a very sensitive ribbon having high heat resistivity and heat transfer properties such that the ribbon is easy to heat and easy to cool.

The ink ribbon formed to have high sensitivity is, when used for printing, heated to a high temperature by the heating portion 3A and immediately thereafter, pressed into contact with a protective layer 5 outside of the low-temperature common electrode 4*a*, whereby heat of the ink ribbon is lost quickly. However, unless the ink ribbon is stripped from the recording medium before the ink heated and fused by the heating portion 3A is cooled to be solidified, the ink ribbon is bonded to the recording medium, thereby not only making it impossible to take up the ink ribbon but also deteriorating separating property and fixing property of the ink. Thus, excellent printing quality at an environmental temperature of, for example, 3°–5° C. can not be obtained.

It may be considered that a distance between the heating portion 3A and the edge portion where the ink ribbon is stripped from the recording medium is shortened, and the width of the common electrode 4*a* is shortened to strip the ink ribbon from the recording medium before the ink is cooled, so that deterioration of separating property and fixing property of the ink can be prevented. However, by shortening the width of the common electrode 4*a*, voltage drop (common drop) due to the increase of the value of resistance of the common electrode 4*a* occur, unevenness of the printing density is generated to deteriorate the printing quality and a life of the printing is reduced.

Furthermore, when the ink is in a fused condition, the slip between the ink ribbon and the recording medium tends to occur. When the slip occurs, relative speed is generated between the ink ribbon and the recording medium to cause unstable traveling of the ink ribbon due to oblique traveling thereof, and unsuitably printing on the recording medium.

SUMMARY OF THE INVENTION

It is an object of the present invention to provide a thermal head capable of effectively using a thin-film ribbon as an ink ribbon, maintaining excellent fixing property of the ink to a recording medium and high printing quality for a long period of time.

DESCRIPTION OF THE PREFERRED EMBODIMENTS

The preferred embodiment of the thermal head according to the present invention will be described with reference to FIGS. 1 and 2.

Figure 1:
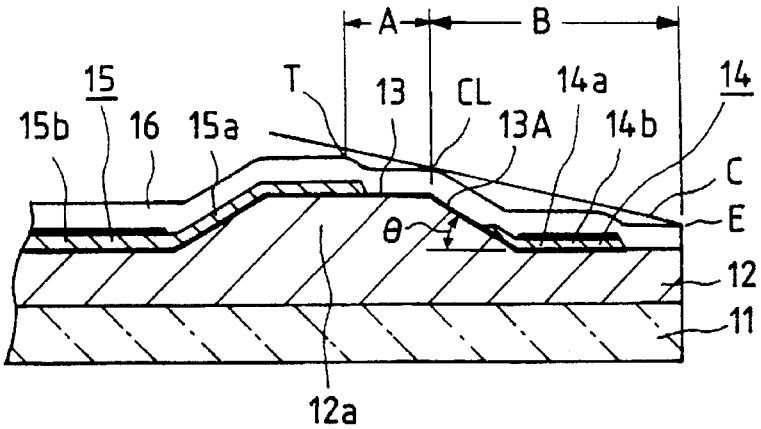
FIG. 1 is a cross sectional view showing a configuration of a thermal head according to an embodiment of the present invention.

FIG. 1 is an enlarged vertical sectional view showing a main part of a thermal head according to an embodiment of the present invention.

The thermal head of this embodiment includes an electrical insulating substrate 11, a glaze layer 12 which functions as a heat reserving layer having a protruding portion 12*a* and composed of a material having low thermal conductivity, heater elements 13 forming a heating portion 13A, a common electrode 14 connected to each of the heater elements 13, a plurality of individual electrodes 15 energizing individually each of the heater elements 13 and a protective layer 16 covering upper portions of the glaze layer 12, the heater elements 13, common electrode 14 and the individual electrodes 15. In this embodiment, the common electrode 14 and the individual electrodes 15 are of two-layer structures comprising lower common electrode 14*a* and upper common electrode 14*b* and lower individual electrodes 15*a* and upper individual electrodes 15*b*, respectively.

Referring more particularly to the thermal head of this embodiment, a glaze layer 12 composed of a heat-resistant glass having low thermal conductivity and functioning as a heat reserving layer is formed on the upper surface of the insulating substrate 11 composed of alumina, ceramic or the like. The protruding portion 12*a* of the glaze layer 12 having an approximately trapezoidal sectional configuration is formed integrally on the top surface by a known method such as a photolithographic technique within an area that forms the heating portion 13A of the heater elements 13, which constitutes a rear end portion (right-hand side) with respect to a travel direction of the thermal head shown by arrows in FIG. 1. In this embodiment, the height of the protruding portion 12*a* is about 10–20 μm, and the taper angle θ which is an angle of the slope thereof is about 15°–25°. The top surface of the protruding portion 12*a* is formed into an approximately flat top surface. This configuration forms a sufficient gap under an imaginary line segment connecting the protruding portion 12*a* and an edge portion E. A plurality of heater elements 13 composed of $Ta_2N$, Ta—$SiO_2$ or the like are adhered to the top surface of the glaze layer 12 by a suitable method such as vapor deposition and sputtering. The lower electrodes 14*a* and 15*a* of the double layer-structured common electrodes 14 and individual electrodes 15 are laminated on both end portions of each of the heater elements 13 along the length thereof, respectively for constituting exposed intermediate portions of each of the heater elements 13 along the length thereof as the heating portion 13A. These lower electrodes 14*a* and 15*a* are constituted by forming Mo and W, etc. which are materials thereof into films having a thickness of about 0.1 μm by vapor deposition, sputtering and the like, and thereafter, by forming a pattern for exposing the intermediate portions of each of the heater elements 13 along the length thereof with a dry etching so as to specify the distance between the electrodes in the heating areas of the heater elements 13 i.e. the dot size of the heating portion 13A by a photolithographic technique.

In this embodiment, the heating portion 13A are formed from the protruding portion 12*a* of the glaze layer 12 to the slope of the rear end portion (the side of the common electrode 14) of the travel direction of the thermal head. In other words, the heating portion 13A are formed by offsetting the center portion CL thereof in the direction of the length of the heating portion 13A at least 10 μm or more from the center portion of the protruding portion 12*a* to the side of the common electrode 14. In FIG. 1, there is shown a displacement between the center portion of the protruding portion 12*a* and the center portion of the heating portion 13A. Along with the displacement A, the lower common electrode 14*a* are formed at the lower position of the protruding portion 12*a*.

The upper electrodes 14*b* and 15*b* composed of Al or the like each having a thickness of about 2 μm are laminated on the lower electrodes 14*a* and 15*a*, respectively, by a photolithographic technique at positions apart outwardly from the boundary portion between the lower electrodes 14*a* and 15*a* and the heater elements 13. A desired protective layer 16 having a thickness of about 5–10 μm is formed on the surfaces of the heat insulating layer 12, heater elements 13, common electrode 14 and individual electrodes 15 so as to protect them. The protective layer 16 covers all of the surfaces of the electrodes 14 and 15 except terminal sections (not shown) thereof. The protective layer 16 is composed of materials such as $SiO_2/Ta_2O_5$ or SIALON having a good oxidation resistance and wear resistance, and formed with a known method such as sputtering or the like.

In this embodiment, in an edge portion B formed between the heating portion 13A of the thermal head and the edge portion E which is a rear end portion (right-hand side in the drawing) with respect to the travel direction of the thermal head and where ink is fixed to a recording medium and an ink ribbon is stripped from the recording medium, the top surface of the protective layer 16 of this part is positioned under the imaginary line segment C, which constitutes a travel path of the ink ribbon, connecting the edge portion E and the center portion CL of the heating portion 13A in the direction of the length thereof. That is, the slope of the protruding portion 12*a* of the side of the common electrode 14 is formed with the taper angle θ of about 15°–20°. The lower common electrode 14*a* is provided at the lower portion of the slope of the protruding portion 12*b*, and the upper common electrode 14*b* is provided by separating outwardly from the end portion of the lower common electrode 14*a* of the side of the heating portion 13A, whereby the top surface of the protective layer 16 of this part is positioned with a space under the imaginary line segment C.

Figure 2:
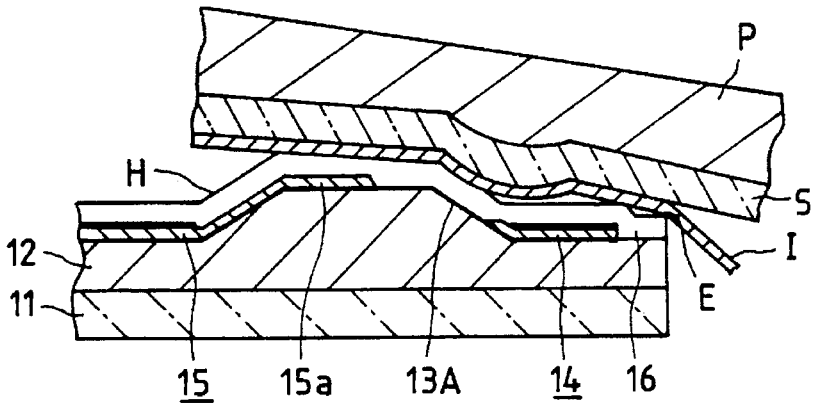
FIG. 2 is a cross sectional view showing a service condition of the thermal head of FIG. 1.
Figure 3:
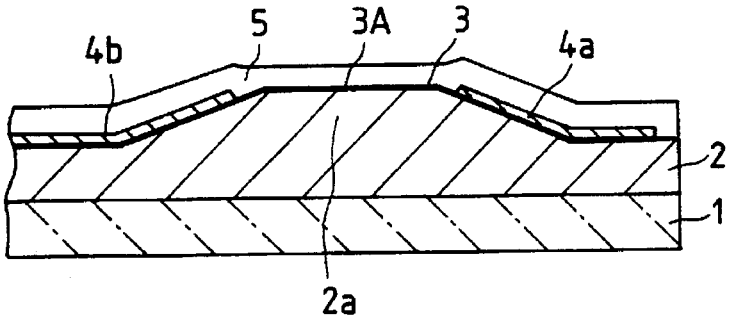
FIG. 3 PRIOR ART
FIG. 3 is a cross sectional view showing a configuration of a conventional thermal head.
Figure 4:
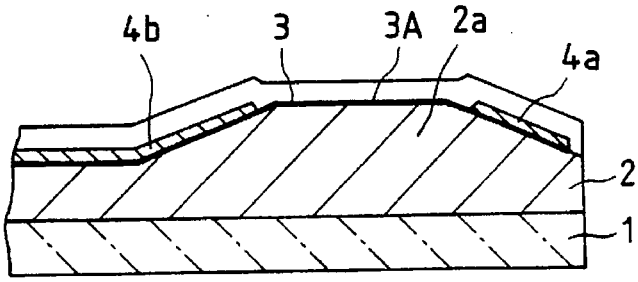
FIG. 4 PRIOR ART
FIG. 4 is a cross sectional view showing a configuration of a conventional thermal head of a real edge type.

A printer equipped with the thermal head of this embodiment is, as shown in FIG. 2, so constructed that a center portion of the top surface of the protruding portion 12*b* which does not generate heat is pressed into contact with a platen P of the printer through the protective layer 16, and a top (center portion CL) of the heating portion 13A is pressed into contact with the platen P of the protective layer 16 by inclining a thermal head H at an angle of about 3° to 5° to the platen P so that the rear end portion of the thermal head H with respect to the travel direction thereof comes close to the platen P with respect to the front end portion thereof.

The operation of the thermal head of this embodiment will now be described.

According to the thermal head of this embodiment, as shown in FIG. 1, the lower individual electrodes 15*a* are formed on the top of the protruding portion 12*a* of the glaze layer 12 on the substrate 11 in such a manner that they are partially projected, and the heating portion 13A is formed by offsetting the center portions CL thereof at least 10 μm or more from the center portion of the top surface of the protruding portion 12*a* to the side of the rear end portion with respect to the travel direction of the thermal head H. Therefore, as shown in FIG. 2, by inclining the thermal head H at an angle of about 3° to 5° to the platen so that the rear end portion of the thermal head H with respect to the travel direction thereof comes close to the platen P with respect to the front end portion thereof, pressure of the printer to the platen P is applied to a part outside the center portion of the heating portion 13A to prevent a slip of an ink ribbon I. Thereafter, the heater elements 13 are selectively heated in the heating portions 13A to fuse partially the ink of the ink ribbon I. The ink ribbon I is transferred to the edge portion E and the fused ink is brought into contact with a recording medium S by pressing the ink ribbon at the edge portion E. Then, the ink ribbon I temporarily adhered to the recording medium S is drawn at the edge portion E to fix the ink to the recording medium S and is stripped from the recording medium S with a further travel (taking-up) of the ink ribbon I.

As described above, in the thermal head H of this embodiment, there are formed the heating portions 13A at the rear end portion of the top of the protruding portion 12*a* with respect to the travel direction thereof and the edge portion E at the rear end portion of the thermal head H with respect to the travel direction thereof which preforms simultaneously fixing of the ink and stripping of the ink ribbon I. And, the top surface of the protective layer 16 in the end portion B formed between the heating portion 13A and the edge portion E is positioned lower than the travel path of the ink ribbon I shown by the imaginary line segment C. Therefore, a gap may be formed between the surfaces of the ink ribbon I and thermal head H. The protective layer 16 on the common electrode 14 which does not generate heat shows a considerably low temperature as compared with the ink ribbon I heated at the heating portion 13A. The presence of the gap can prevent the ink ribbon I heated by the contact with the heating portion 13A from being pressed into contact with the protective layer 16 formed on the surfaces of the common electrode 14. Thus, the cooling speed of the ink ribbon I decreases, the ink ribbon can be carried to the edge portion E with keeping a suitable temperature for printing, bonding of the ink ribbon to the recording medium S due to solidification of the ink can be prevented and good printing can be performed. For example, since the heat loss of the ink ribbon is small, a large dot size can be obtained and the printing density can be increased.

Furthermore, the thermal head H of this embodiment is so constructed that the common electrode 14 is not pressed into contact with the ink ribbon I strongly even if sufficient wiring spaces are taken for the common electrodes 14 because a sufficient gap is formed on the common electrode 14 as described above. Thus, the common electrode 14 is formed with a sufficient large size, common drop becomes difficult to cause and durability of the common electrodes 14 can be improved.

In addition, by forming the heating portion 13A with offsetting it from the center portion of the protruding portion 12*a* to the side of the rear end portion with respect to the travel direction of the thermal head H, the length of the end portion B can be shortened to some extent. Thus, a thin film ink ribbon having keen thermal responsivity can be used more effectively.

Still further, by forming the heating portion 13A with offsetting it from the center portion of the protruding portion 12*a* to the side of the rear end portion with respect to the travel direction of the thermal head H, the lower individual electrodes 15*a* project to the top of the protruding portion 12*a*. The top of the projected lower individual electrodes 15*a* always presses the ink ribbon I and the recording medium S into contact with the platen P of the printer, thereby securing stable travel of the ink ribbon I without causing a slip between the ink ribbon and the recording medium S even if the ink heated by the heating portion 13A is liquefied to lower the friction between the ink ribbon I and the recording medium S, and improving color overlaying accuracy of each color of yellow, magenta and cyan in the color printing to obtain excellent printing quality.

When a printer equipped with the thermal head H of this embodiment is so constructed that a thermal head H is inclined at an angle of about 3° to 5° to the platen P so that the rear end portion of the thermal head H with respect to the travel direction thereof comes close to the platen P with respect to the front end portion thereof so as to press the protruding portion 12*a* into contact with the platen P, contacting property of the heating portions 13A and the platen P is improved and printing quality can be further improved.

Furthermore, the printer constructed as described above increases friction between the thermal head H and the ink ribbon I at the edge portion E. Thus, fixing property of the ink of the ink ribbon I to the recording medium S can be improved and printing quality can be stabilized.

According to the thermal head constructed as described above, the heating portion is formed from the top of the heat insulating layer to the slope thereof of the common electrode side. When the thermal head is applied to the thermal transfer printer, a pressure of the printer to the platen can be mainly applied to a portion where the top of the heat insulating layer is outside the center portion of the heating portion. Therefore, even if the ink of the ink ribbon heated by the contact with the heating portion is fused to reduce the friction between the ink ribbon and the recording medium, slip of the ink ribbon does not occur because the top portion of the low-temperature heat insulating layer strongly presses the ink ribbon and the recording medium into contact with the platen. As a result, color overlaying accuracy of each of the colors is improved and excellent printing quality can be obtained.

In addition, if the slope of the heat insulating layer of common electrode side is located under the imaginary line segment connecting the end portion of the common electrode which is a traveling path of the ink ribbon and the top of the heat insulating layer, the ink of the ink ribbon heated and fused by the contact with the heating portion also comes in contact with the protective layer on the common electrode having a low temperature and is not cooled to be solidified. Therefore, even if the edge distance is relatively prolonged, the ink ribbon can be stripped from the recording medium during a high-temperature condition, and excellent printing quality can be obtained.

Furthermore, if the slope of the heat insulating layer of the common electrode side is located under the imaginary line segment connecting the end portion of the common electrode side and the top portion of the heat insulating layer, the ink ribbon can be stripped from the recording medium during the high-temperature condition without strongly bringing the ink ribbon into contact with this portion. Therefore, the common electrode can be provided in a wide range to prevent occurrence of common drop, and the edge distance can be shortened to some degree by the length of the offset of the heating portion to the common electrode side.

What is claimed is:

1. A thermal head comprising:

a substrate;

a heat insulating layer formed on said substrate, the heat insulating layer including a protruding portion having an upstream sloped side, a downstream sloped side and a top portion extending between the upstream sloped side and the downstream sloped side;

a plurality of individual electrodes, each of the plurality of individual electrodes formed on said heat insulating layer and extending up the downstream sloped side to the top portion of the protruding portion; and a common electrode formed on said heat insulating layer and extending to the upstream sloped side of the protruding portion;

wherein a plurality of heating portions are exposed between the plurality of individual electrodes and the common electrode, each of the plurality of heating portions extends from the top portion of said protruding portion and down the upstream sloped side to said common electrode.

2. A thermal head according to claim 1, wherein said plurality of individual electrodes is extended to an uppermost portion of the top of said heat insulating layer.

3. A thermal head according to claim 2, wherein a slope of said heat insulating layer of said upstream sloped side is located under an imaginary line segment connecting an end portion of said common electrode and the top portion of said insulating layer so as to form a gap.

4. A thermal head according to claim 1, wherein a slope of said heat insulating layer of said upstream sloped side is located under an imaginary line segment connecting an end portion of said common electrode and the top portion of said heat insulating layer so as to form a gap.

5. A thermal head for a thermal transfer printer, the thermal transfer printer including a platen and means for moving the thermal head in a printing direction relative to the platen, the thermal head comprising:

a substrate;

a heat insulating layer formed on said substrate, the heat insulating layer including a protruding portion having a first sloped side located upstream in the printing direction, a second sloped side located downstream in the printing direction and a top portion extending between the first sloped side and the second sloped side;

a plurality of individual electrodes, each of the plurality of individual electrodes formed on said heat insulating layer and extending up the second sloped side to the top portion of the protruding portion; and a common electrode formed on said heat insulating layer and extending to the first sloped side of the protruding portion;

wherein a plurality of heating portions are exposed between the plurality of individual electrodes and the common electrode, each of the plurality of heating portions being located on the first sloped side of the protruding portion.

6. A thermal head according to claim 5, wherein said individual electrode is extended to an uppermost portion of the top of said heat insulating layer.

7. A thermal head according to claim 6, wherein a slope of said heat insulating layer of said upstream sloped side is located under an imaginary line segment connecting an end portion of said common electrode and the top portion of said insulating layer so as to form a gap.

8. A thermal head according to claim 5, wherein a slope of said heat insulating layer of said upstream sloped side is located under an imaginary line segment connecting an end portion of said common electrode and the top portion of said heat insulating layer so as to form a gap.

* * * * *